United States Patent [19]

Koch

[11] Patent Number: 5,013,046

[45] Date of Patent: May 7, 1991

[54] MULTIPLE MARK GOLF BALL AND PLAYING METHOD

[76] Inventor: Tobias Koch, 6 N. Morgan Ave., Havertown, Pa. 19083

[21] Appl. No.: 410,250

[22] Filed: Sep. 20, 1989

[51] Int. Cl.[5] ..... A63B 43/00

[52] U.S. Cl. ..... 273/213; 40/327

[58] Field of Search ..... 273/213, 183 C, 183 E; 40/327; D21/204, 205

[56] References Cited

U.S. PATENT DOCUMENTS

| | | | |
|---|---|---|---|
| 676,506 | 1/1901 | Knight et al. | 273/213 |
| 906,932 | 12/1908 | Riblet | 273/232 |
| 3,630,601 | 12/1971 | Lehovec | 273/183 C |
| 4,235,441 | 11/1980 | Ciccarello | 273/213 |
| 4,603,862 | 8/1986 | Chen | 273/183 C |
| 4,664,387 | 5/1987 | Tardiff | 273/183 C |
| 4,706,958 | 11/1987 | Inoue | 273/213 |

OTHER PUBLICATIONS

*The Golf Ball Presented by Titleist #1 Ball in Golf*, p. 4, "The Hand-Hammered Gutta (circa 1870-1880)", Copyright 1989 by Titleist Golf Division, The Acushnet Company.

*Primary Examiner*—George J. Marlo

*Attorney, Agent, or Firm*—John F. A. Earley; John F. A. Earley, III

[57] ABSTRACT

A golf ball which is easily identified without touching the ball, rolling it over or picking it up, even though it may lie in deep rough or be almost completely buried in a sand trap. A method of making a better golf shot comprising providing a golf ball with a multitude of separate and distinct identifying marks on the cover being spaced-apart so that at least one mark is visible to the eye no matter how the ball lies, and whether or not it lies in deep rough or is almost completely buried in a sand trap, and a method whereby the golfer focuses his or her eyes on a single selected mark without distraction from other marks. A method of making a better golf putt comprises placing the golf ball on the putting green so that the circumferential line of marks is on the line of the intended putt, striking the ball with the putter so that the line of marks gives the appearance of a straight line when the ball is rolling after being struck by a good putting stroke, and gives the appearance of a wobbly line after the ball is struck by a poor putting stroke.

11 Claims, 6 Drawing Sheets

Fig. 5
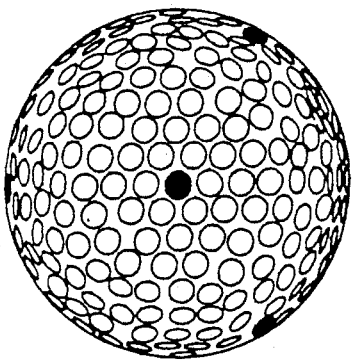
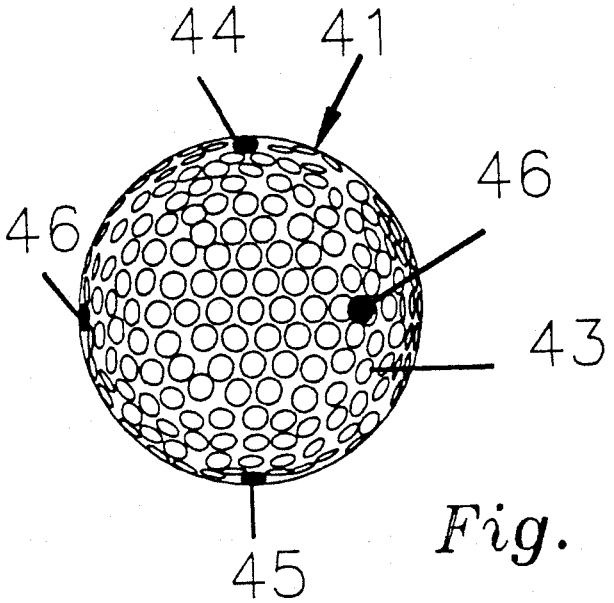
Fig. 6a
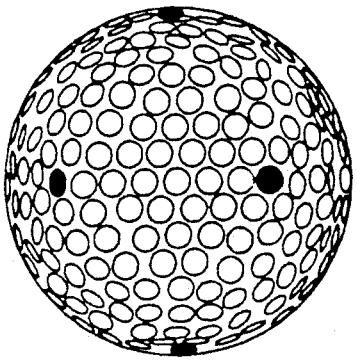
Fig. 6b

MULTIPLE MARK GOLF BALL AND PLAYING METHOD

BACKGROUND OF THE INVENTION

This invention relates to golf balls and a method of striking them with a golf club, and more particularly concerns a golf ball which is easily identified without touching it, rolling it over, or picking it up, even though it may lie in deep rough or may be almost completely buried in a sandtrap, and with a method of making a better golf shot with this ball and a better golf putt with this ball.

Most golf balls today are marked once on the cover with the name of the manufacturer and an identifying number which may vary from the number 1 to the number 8.

However, when the ball is hit into deep rough or into a sandtrap and is almost completely buried, it is difficult to identify it without touching it, rolling it over, or picking it up, and this presents a problem which the present invention is designed to solve.

Also, every golfer has, at one time or another, been advised to "keep your head down" or "keep your eye on the ball." This seems very easy to do, but in actual practice has been found to be very hard to do. In executing the golf swing, it can be said that "as the head is moved, so are the big body muscles which are triggered by the head." Even the slightest imperceptible movement of the golfer's head, as the golfer executes his golf swing, can result in a badly executed shot.

SUMMARY OF THE INVENTION

The present invention provides a golf ball which is easily identified. The inventive golf ball has a cover, and is provided with means for identifying the golf ball without touching it, rolling it over, or picking it up, even though it may lie in deep rough or may be almost completely covered in a sandtrap. The identifying means comprises a multitude of identifying marks on the cover, with the marks being spaced apart so that at least one mark is visible to the eye no matter how the ball lies, and whether or not it lies in deep rough or is almost completely buried in a sandtrap. The inventive golf ball is also provided with means for concentrating the golfer's gaze on one selected mark on the golf ball without being distracted by the other marks. The concentration means comprises spacing the marks apart sufficiently that a golfer can concentrate his eyes on one selected mark, without being distracted by the closeness of other marks, and thereby hit a better golf shot.

The inventive method of making a better golf shot comprises the steps of providing a golf ball having a cover and means for identifying the golf ball which comprises a multitude of identifying marks on the cover, with the marks being spaced apart so that at least one mark is visible to the eye no matter how the ball lies, and providing the golf ball with means for concentrating the golfer's gaze on one selected mark on the golf ball, without distraction from the other marks, by spacing the marks apart sufficiently that a golfer can concentrate his eyes on one selected mark, without being distracted by the closeness of the other marks, and thereby hit a better shot. The method comprises the steps of providing such a golf ball, addressing the golf ball with a golf club, focusing your eyes on a single selected mark, and swinging the golf club at the selected mark to thereby hit a better golf shot.

The method of making a better golf shot also includes the further steps of finding the golf ball, identifying the golf ball as yours by looking at one or more of the multitude of spaced-apart identifying marks on the golf ball, again addressing the found golf ball, focusing your eyes on a single selected mark on the golf ball and hitting the golf ball again.

The method of making a better golf putt comprises the steps of providing a golf ball having a cover and means for identifying the golf ball which comprises a multitude of identifying marks on the cover, with the marks being spaced apart around the circumference of the cover along the equator of the ball, or on the North-South line of the ball, or any latitude lines of the ball, or any longitudinal lines of the ball, or along a circumferential line parallel to the North-South line, so that the marks give the appearance of a straight line when the ball is rolling after being struck by a good putting stroke, and give the appearance of a wobbly line after the ball is struck by a poor putting stroke.

BRIEF DESCRIPTION OF THE DRAWINGS

FIG. 5 is a view in plan of another embodiment of the golf ball constructed in accordance with the invention;

FIGS. 6*a* and 6*b* show two side elevations of the golf ball of FIG. 5;

DETAILED DESCRIPTION OF THE INVENTION

Figure 1:
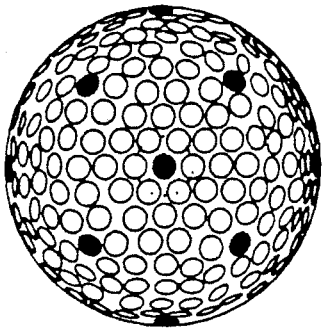
FIG. 1 is a view in plan of a golf ball constructed in accordance with the invention.
Figure 2A:
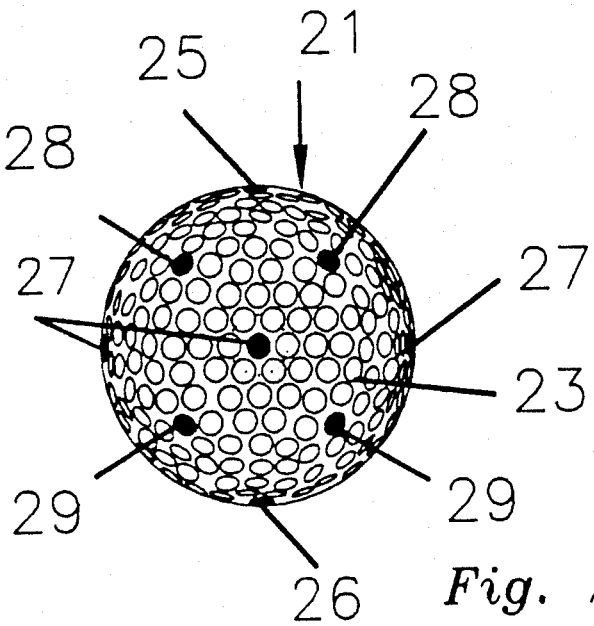
FIGS. 2*a* and 2*b* show two side elevations of the golf ball of FIG. 1.
Figure 2B:
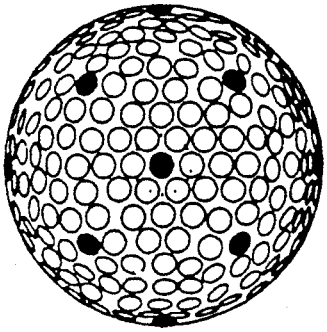

Turning to the drawings, FIGS. 1 and 2 show a golf ball 21 which is provided with a cover 23 and with means for identifying the golf ball 21 which comprises a multitude of identifying marks 25–29, which are fourteen in number on golf ball 21. Mark 25 is at the north pole, mark 26 is at the south pole, four marks 27 are equally spaCed around the equator of the ball 21, four marks 28 are equally spaced around the ball 21 at 45° north latitude, and four marks 29 are equally spaced around the ball 21 at 45° south latitude.

The four marks 28 at 45° north latitude, and the four marks 29 at 45° south latitude, are staggered with respect to the four marks 27 around the equator of the ball 21.

Figure 3:
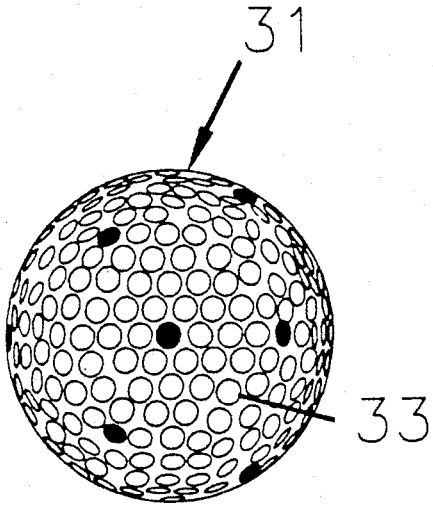
FIG. 3 is a view in plan of another embodiment of the golf ball according to the invention.
Figure 4A:
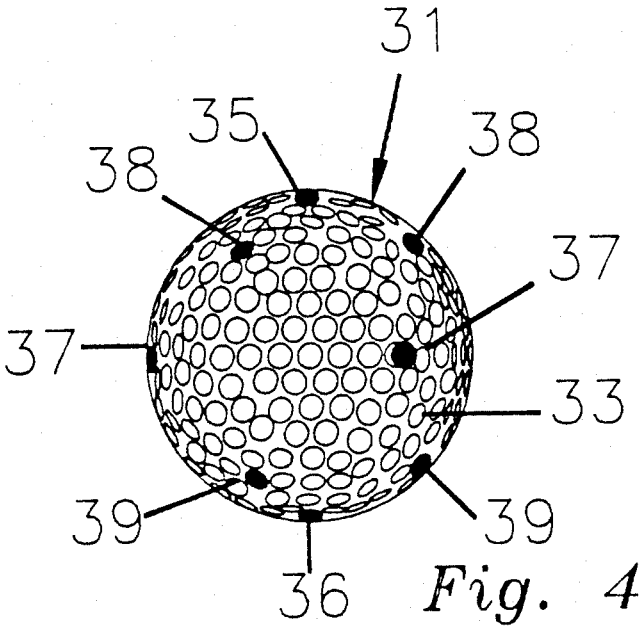
FIGS. 4*a* and 4*b* show two views in side elevation of the golf ball of FIG. 3.
Figure 4B:
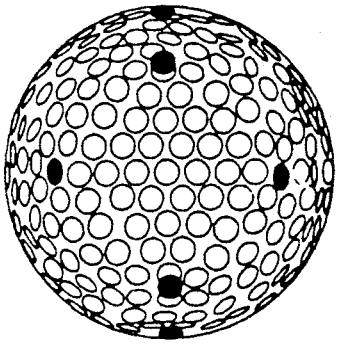

FIGS. 3 and 4 show an 11-mark version of the invention, a golf ball 31 with a cover 33 and a north pole mark 35, a south pole mark 36, three equally spaced-apart equator marks 37, three equally spaced-apart 45° north latitude marks 38, and three equally spaced-apart 45° south latitude marks 39.

FIGS. 5 and 6 show a 5-mark version of the invention in a golf ball 41 having a cover 43 provided with a north pole mark 44, a south pole mark 45, and three equally spaced apart marks 46 at the equator. Ball 41 is not provided with any marks at 45° north latitude nor at 45° south latitude.

Figure 7:
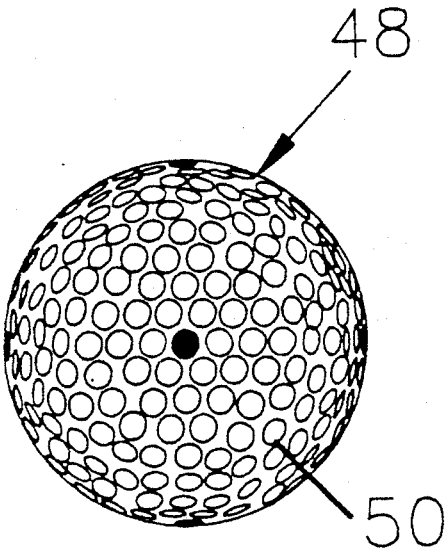
FIG. 7 is a view in plan of another embodiment of the invention.
Figure 8A:
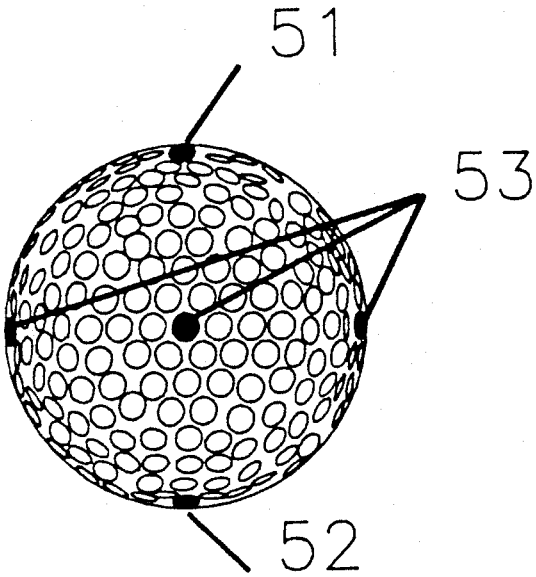
FIGS. 8*a* and 8*b* show two elevation views of the golf ball of FIG. 7.
Figure 8B:
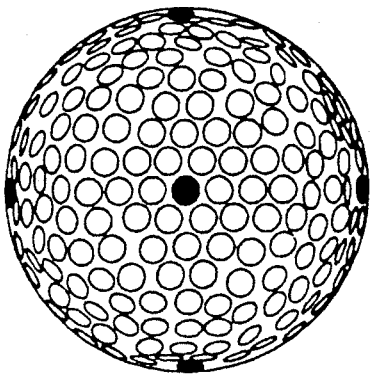

FIGS. 7 and 8 show a 6-mark version of the invention, and illustrate a golf ball 48 having a cover 50 with a north pole mark 51, a south pole mark 52, and four marks 53 equally spaced around the equator of the ball 48.

The method of making a better golf shot in accordance with the invention comprises the steps of providing a golf ball 21, addressing golf ball 21 with a golf club, focusing your eyes on a single selected mark of the marks 25–29 on the golf ball without being distracted by the other marks on the golf ball which are spaced a sufficient distance away from the selected mark so as to not be distracting, and swinging the golf club at the selected mark on the golf ball to thereby hit a better golf shot.

The method further includes the steps of finding the golf ball 21, and identifying the golf ball as yours by looking at one or more of the multitude of spaced-apart identifying marks 25–29 without touching the ball, rolling it over, or picking it up, even though the ball may lie in deep rough or may be almost completely buried in the sand of a sandtrap.

The method includes the further steps of again addressing the found ball, again focusing your eyes on a single selected mark 25–29 on the golf ball without being distracted by adjacent marks which are spaced sufficiently apart so that they do not distract you, and swinging the golf club at the selected mark on the golf ball to thereby hit a better golf shot.

The method of making a better golf putt in accordance with the invention comprises the steps of providing a golf ball, such as the fourteen-mark golf ball 21 of FIGS. 1–2, having a cover 23 and means for identifying the golf ball 21 which comprises fourteen identifying marks 25–29 distributed on the cover 23 as shown in FIGS. 1–3 and as previously described. The marks 25–29 are spaced around the cover 23 with four marks 27 being equally spaced around the equator of the ball 21, four marks 25, 26, and two of the marks 27 being equally spaced on the North-South longitude line of the ball 21, and four marks 28 being equally spaced around 45° North latitude of the ball 21, and four marks 29 being equally spaced along the 45° South latitude line of the ball. Accordingly, when the equator marks 27, for example, are placed along the desired line of the putt, when the ball 21 is struck properly by a putter, and the ball is rolling after being struck by a good putting stroke, the lines formed by the rolling marks 27 give the appearance of a straight line when the ball is rolling after being struck by a good putting stroke. The line formed by the marks 27, on the other hand, when the ball is struck by a bad putting stroke, give the appearance of a wobbly line after the ball 21 is struck by the poor putting stroke.

The purpose of this invention is multipurpose.

The multiple markings are indelibly and permanently imprinted on the cover of the golf ball, and they enable the golfer, his caddy, golf partners and competitors to more readily identify the golfer's ball in the course of play. The majority of golf balls in use today have identifying marks on them, generally the manufacturer's trademark and numbers, usually any number from 1 to 8. The only time these markings are visible, and positively and readily identifiable, is when when the ball is teed up, or when the ball is placed on the putting green. In the majority of cases, in the normal course of play, the ball is played from where it lies and is quite frequently unidentifiable without close scrutiny. For example, a conventional golf ball is very hard to identify when partly buried in bunkers (sandtraps), and when buried in the rough (high grass generally bordering the fairways and the greens).

The golf balls of the present invention are provided with multiple markings, or multiple spots of varying size, and may vary in patterns and/or in color, and may be made in an unlimited combination of patterns for identifying the ball as being the property of the golfer who puts the ball in play.

Turning now to FIGS. 9 and 10, there is shown a number of embodiments of the invention which are somewhat different from each other.

Figure 9E:
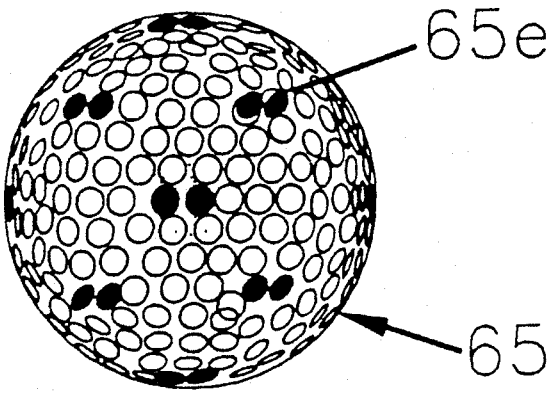
FIGS. 9*a*–9*f* show views in side elevation of various embodiments of the inventive golf ball with each showing different marks.
Figure 9F:
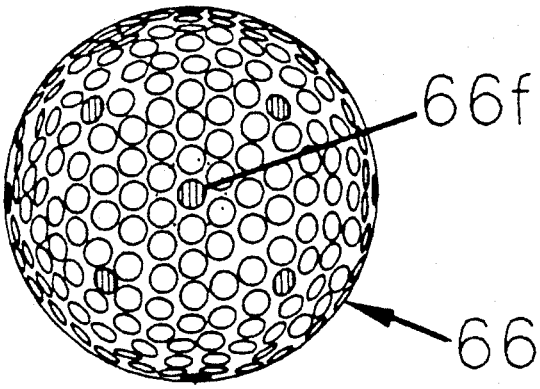
Figure 9C:
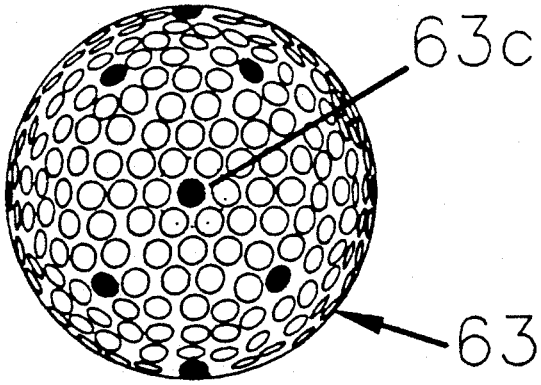
Figure 9D:
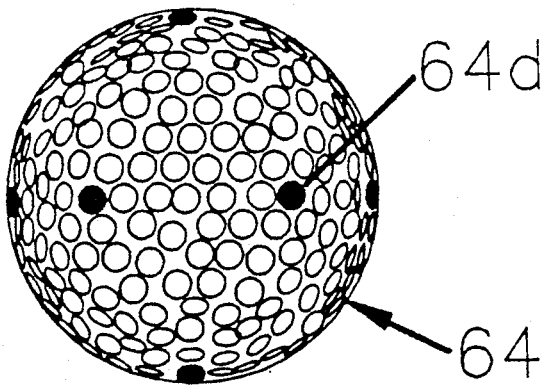
Figure 9A:
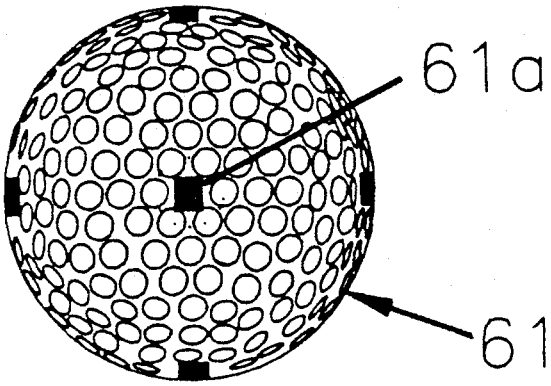
Figure 9B:
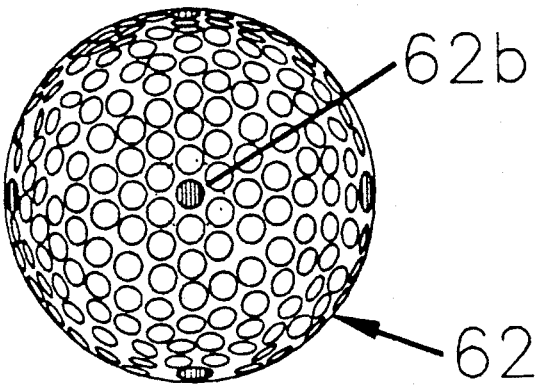

FIG. 9*a* shows a golf ball 61 with six square marks 61*a* positioned with a square mark at the North pole and at the South pole, and four marks equally spaced around the equator of the ball. FIG. 9*b* shows a golf ball 62 with six red dots 62*b* positioned with a red dot at the North pole and at the South pole and four dots equally spaced around the equator of the ball. FIG. 9*c* shows a golf ball 63 with fourteen dots 63*c* positioned with one dot at the North pole and another dot at the South pole, four dots equally spaced around the equator of the ball, four dots equally spaced around 45° North latitude and staggered between the dots at the equator of the ball, and four dots positioned at 45° South latitude, equally spaced apart, and staggered with respect to the four dots at the equator of the ball.

FIG. 9*d* shows a golf ball 64 with eight dots 64*d* with one dot at the North pole, one dot at the South pole, and six dots equally spaced around the equator of the ball. FIG. 9*e* shows a golf ball 65 with fourteen double-dots 65*e*, with one double dot at the North pole, one double-dot at the South pole, four double-dots equally spaced around the equator of the ball, four double-dots equally spaced around 45° North latitude and staggered with respect to the four dots at the equator, and four double-dots positioned at 45° South latitude and equally spaced and staggered with respect to the four double-dots at the equator of the ball. FIG. 9*f* shows a golf ball 66 with fourteen red dots 66*f*, with the red dots 66*f* positioned in the same manner as the double-dots 65*e* in FIG. 9*e*.

Figure 10E:
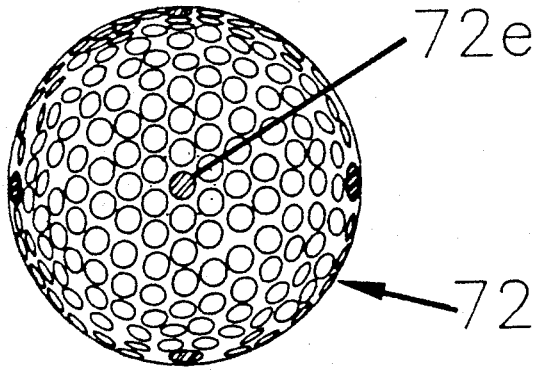
FIGS. 10*a*–10*f* show views in side elevation of various embodiments of the inventive golf ball with each showing different marks.
Figure 10F:
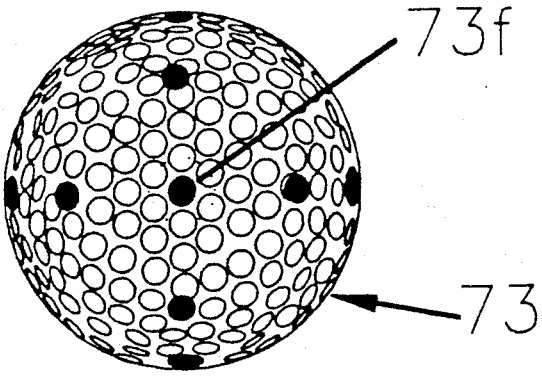
Figure 10C:
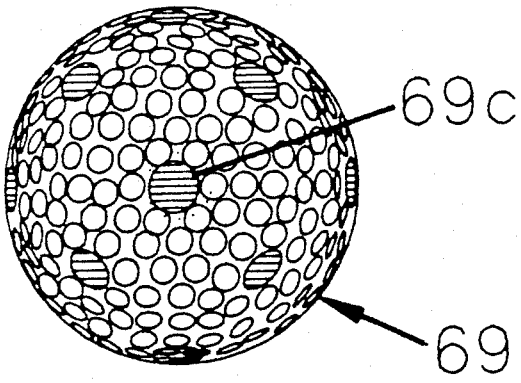
Figure 10D:
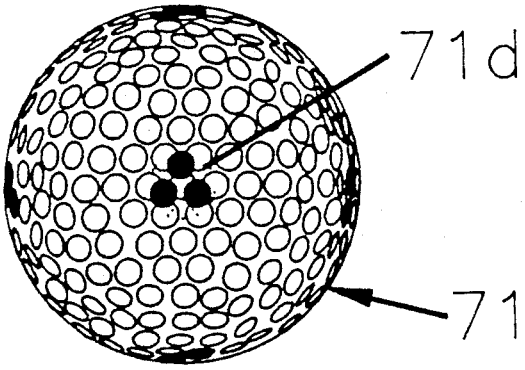
Figure 10A:
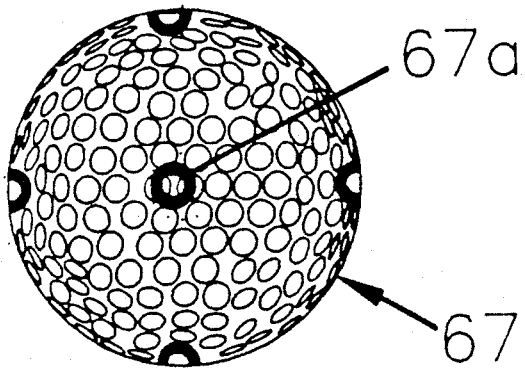
Figure 10B:
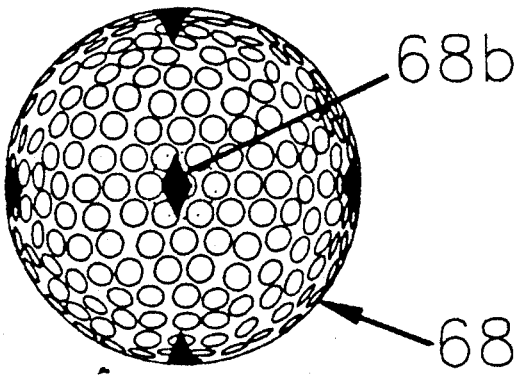

FIG. 10*a* shows a golf ball 67 with six doughnut-type marks 67*a*, with four marks 67*a* positioned around the equator of the ball and equally spaced apart, and one mark 67*a* at the North pole and one mark 67*a* at the South pole of the ball 67. FIG. 10*b* shows a golf ball 68 with six diamond marks 68*b* distributed over golf ball 68 in the same manner as the marks 67*a* are distributed over the golf ball 67. FIG. 10*c* shows a golf ball 69 with fourteen blue dots 69*c* positioned with one dot 69*c* at the North pole and another dot 69*c* at the South pole, four dots 69*c* positioned around the equator of the ball 69 with each dot 69*c* being 90° apart, four blue dots 69*c* being positioned at 45° North latitude at 90° apart and staggered in relation to the four blue dots 69*c* around the equator, and four blue dots 69*c* positioned at 45° South latitude an equal distance apart and staggered with relation to the four blue dots 69*c* around the equator of the ball 69. FIG. 10*d* shows a golf ball 71 with six triple-dots 71*d* with one triple-dot 71*d* at the North pole and another at the South pole of the ball, and four triple-dots positioned around the equator of the ball an equal distance apart.

FIG. 10*e* shows a golf ball 72 with six brown marks 72*e* with one brown mark 72*e* at the North pole and another at the South pole, and with four brown marks 72*e* positioned an equal distance apart around the equator of the ball 72. FIG. 10*f* shows a golf ball 73 with fourteen dots 73*f* with one dot 73*f* at the North pole and another at the South pole, eight dots 73*f* equally spaced apart around the equator of the ball 73, and eight dots 73*f* equally spaced apart around the North-South axis of the ball 73. It will be realized that two of the dots 73*f* do double duty in that they are part of the equator dots and also the North-South dots 73*f*.

A purpose of the multiple-mark golf ball of the invention is to pinpoint or focus the golfer's gaze, his eyes, and in turn his head, on a mark or spot on the golf ball, a spot which is appreciably smaller than the golf ball itself. Even the slightest movement of the golfer's head as he executes his swing can result in a badly executed shot. By playing the multiple-mark golf ball of the invention, the golfer can fix his eyes, and in turn his head, on a precise spot on the ball, thus assuring himself of a more repetitive swing time after time.

Many golfers frequently practice at golf club driving ranges where they generally use the easily recognizable "banded or striped" range balls. Where they are permitted to use their own practice balls, and this is the case in many country clubs, the inventive ball is of advantage since it is much easier to distinguish the multiple-make balls from the banded range balls.

The multiple-mark ball of this invention enhances the ability of the golfer to concentrate his gaze and keep his eye on the ball by providing the opportunity for the golfer to fix his gaze on a selected spot on the ball, rather than on the relatively larger golf ball itself. Moreover, when the golf ball is played as it lies, which is the case in most tournament play, with a conventional golf ball there is a tendency for the head to move, and this produces a bad shot.

While the number of markings on the multiple-mark golf ball is not limited except by the ability of the golfer to see one of the marks when the ball is partially buried in the sand or is buried in the rough, it is felt that the preferred embodiment of the invention is the fourteen-mark version of FIGS. 1 and 2.

In cases where the ball is completely embedded in the sand of a bunker or a sandtrap, the rules of golf permit the golfer to remove a sufficient amount of sand so that he can positively identify his ball. Obviously, the multiple-mark golf ball of this invention would require that he remove less sand to identify his ball, and therefore minimize the chances of his improving his lie.

I claim:

1. A golf ball which is easily identified without touching it, rolling it over, or picking it up, even though it may lie in deep rough or may be almost completely buried in a sandtrap, comprising a golf ball having an outside surface, means for identifying the golf ball and distinguishing it from the golf balls of others without touching it, rolling it over, or picking it up, even though it may lie in deep rough or may be almost completely buried in a sandtrap, said means comprising a multitude of identifying marks on the outside surface of the ball, said marks being separate and discrete and spaced apart so that at least one mark is almost always visible to the eye no matter how the ball lies, and whether or not it lies in deep rough or is almost completely buried in a sandtrap, said marks being different from the marks on similar golf balls having a multitude of identifying marks on their outside surface so as to distinguish said golf ball from said similar golf balls and enable a golfer to identify his ball and distinguish his ball from the ball of others even when it is almost buried in a sandtrap or in the rough.

2. The golf ball of claim 1, including means for concentrating the golfer's gaze on one selected mark on the golf ball without distraction from the other marks, said means being spacing apart the separate and discrete marks sufficiently that a golfer can concentrate his eyes on one selected mark without being distracted by the closeness of other marks, some marks being on the lines of great circles around the ball, and some marks being on latitude lines or longitude lines around the ball.

3. The golf ball of claim 1, the marks being fourteen in number, with one mark at the north pole of the ball, another mark at the south pole of the ball, four marks equally spaced around the equator of the ball, four marks equally spaced around the ball at 45° north latitude, and four marks equally spaced around the ball at 45° south latitude.

4. The golf ball of claim 3, the four marks at 45° north and south latitude being staggered with respect to the four marks around the equator of the ball.

5. A golf ball which is easily identified without touching it, rolling it over, or picking it up, even though it may lie on deep rough or may be almost completely buried in a sandtrap comprising a golf ball having an outer surface, means for identifying the golf ball and distinguishing it from the golf balls of others without touching it, rolling it over, or picking it up, even though it may lie in deep rough or may be almost completely buried in a sandtrap, said means comprising a multitude of identifying marks on the outside surface of the ball, said marks being separate and discrete and spaced apart so that at least one mark is visible to the eye no matter how the ball lies, and whether or not it lies in deep rough or is almost completely buried in a sandtrap, said marks being different from the marks on similar golf balls having a multitude of identifying marks on their outside surface so as to distinguish said golf ball from said similar golf balls and enable a golfer to identify his ball and distinguish his ball from the ball of others even when it is almost buried in a sandtrap or in the rough, means for concentrating the golfer's gaze on one selected mark on the golf ball without distraction from the other marks, said means being spacing apart the separate and discrete marks sufficiently that a golfer can concentrate his eyes on one selected mark without being distracted by the closeness of other marks, the marks being fourteen in number, with one mark at the north pole of the ball, another mark at the south pole of the ball, four marks equally spaced around the equator of the ball, four marks equally spaced around the ball at 45° north latitude, four marks equally spaced around the ball at 45° south latitude, the four marks at 45° north and south latitude being staggered with respect to the four marks around the equator of the ball.

6. A method of making a better golf shot comprising, providing a golf ball which is easily identified, said golf ball having an outside surface, means for identifying the golf ball and distinguishing it from the golf ball of others without touching it, rolling it over, or picking it up, even though it may lie in deep rough or may be almost completely buried in a sandtrap, said means comprising a multitude of identifying marks on the outside surface of the ball, said marks being separate and discrete and spaced apart so that at least one mark is visible to the eye no matter how the ball lies, and whether or not it lies in deep rough or is almost completely buried in a sandtrap, said marks being different from the marks on similar golf balls having a multitude of identifying marks on their outside surface so as to distinguish said golf ball from said similar golf balls and enable a golfer to identify his ball and distinguish his ball from the ball of others even when it is almost buried in a sandtrap or in the rough, means for concentrating the golfer's gaze on one selected mark on the golf ball without being distracted by the other marks, said means being spacing apart the separate and discrete marks sufficiently that a golfer can concentrate his eyes on one selected mark without being distracted by the closeness of other marks, addressing the golf ball with a golf club, focusing your eyes on a single selected mark without distraction from the other marks, and swinging the golf club at the selected mark to thereby execute a better golf shot.

7. The method of claim 6, including the further steps of finding the golf ball after you hit it, and identifying the golf ball as yours by looking at one or more of the multitude of separate discrete spaced-apart identifying marks without touching the ball, rolling it over, or picking it up, even though it may lie in deep rough or may be almost completely buried in a sandtrap.

8. The method of claim 7, including addressing the found ball again, focusing again your eyes on a single selected mark.

swinging the golf club at the selected mark on the golf ball to thereby hit a better golf shot, and hitting the ball again.

9. A method of making a better golf shot comprising, providing a golf ball which is easily identified, said golf ball having an outside surface, means for identifying the golf ball and distinguishing it from the golf balls of others without touching it, rolling it over, or picking it up, even though it may lie in deep rough or may be almost completely buried in a sandtrap, said means comprising a multitude of identifying marks on the outside surface of the ball, said marks being spaced apart so that at least one mark is visible to the eye no matter how the ball lies, and whether or not it lies in deep rough or is almost completely buried in a sandtrap, said marks being different from the marks on similar golf balls having a multitude of identifying marks on their outside surface so as to distinguish said golf ball from said similar golf balls and enable a golfer to identify his ball and distinguish his ball from the ball of others even when it is buried in a sandtrap or in the rough, means for concentrating the golfer's gaze on one selected mark on the golf ball without being distracted by the other marks, said means being spacing apart the marks sufficiently that a golfer can concentrate his eyes on one selected mark without being distracted by the closeness of other marks, addressing the golf ball with a golf club, focusing your eyes on a single selected mark, swinging the golf club at the selected mark to thereby hit a better golf shot, finding the golf ball almost completely buried in a sandtrap, identifying the golf ball as yours by looking at the one of the multitude of spaced-apart identifying marks which is not covered by sand and can be seen without touching the ball, rolling it over, or picking it up, addressing the found ball in the sandtrap, focusing again your eyes on the single selected mark that can be seen, and swinging the golf club at the selected mark on the golf ball to thereby hit a better golf shot.

10. A method of making a better golf putt, comprising providing a golf ball having an outside surface, means for identifying a golf ball and distinguishing it from the golf balls of others without touching it, rolling it over, or picking it up, even though it may lie in deep rough or may be almost completely buried in a sandtrap, said means comprising a multitude of identifying marks on the cover, said marks being spaced apart so that at least one mark is visible to the eye no matter how the ball lies, and whether or nor it lies in deep rough or is almost completely buried in a sandtrap, means for concentrating the golfer's gaze on one selected mark on the golf ball without being distracted by the other marks, said means being spacing apart the marks sufficiently that a golfer can concentrate his eyes on one selected mark without being distracted by the closeness of other marks, placing the golf ball on the putting green so that a circumferential line of marks is in line with the intended putting line, and striking the ball with the putter so that the circumferential line of marks gives the appearance of a straight line when the ball is rolling after being struck by a good putting stroke, and so that the line of marks gives the appearance of a wobbly line after the ball is struck by a poor putting stroke.

11. At least two golf balls which are easily identified without touching them, rolling them over, or picking them up, even though they may lie in deep rough or may be almost completely buried in a sandtrap, comprising at least two golf balls having outside surfaces, means for identifying each golf ball and distinguishing it from the other without touching them, rolling them over or picking them up, even though they may lie in deep rough or may be almost completely buried in a sandtrap, said means comprising a multitude of identifying marks on the outside surfaces of the balls, the identifying marks on one ball being different from the identifying marks on the other ball, said marks being separate and discrete and spaced-apart so that at least one mark is visible to the eye no matter how the ball lies, whether or not they lie in deep rough or are almost completely buried in a sandtrap, the marks on one ball being different from the marks on the other ball so that one player may distinguish his ball from the ball of another player by looking at a single mark.

* * * * *

UNITED STATES PATENT AND TRADEMARK OFFICE

CERTIFICATE OF CORRECTION

PATENT NO. : 5,013,046

DATED : May 7, 1991

INVENTOR(S) : Tobias Koch

It is certified that error appears in the above-identified patent and that said Letters Patent is hereby corrected as shown below:

Column 5, line 32, change "make" to --mark-- .

Signed and Sealed this

Twenty-second Day of September, 1992

*Attest:*

DOUGLAS B. COMER

*Attesting Officer*

*Acting Commissioner of Patents and Trademarks*